United States Patent [19]

West

[11] 4,269,013

[45] May 26, 1981

[54] INSULATED BUILDING BLOCK WALL CONSTRUCTION

[76] Inventor: Earl L. West, 17990 Ixonia Ave. West, Lakeville, Minn. 55044

[21] Appl. No.: 33,793

[22] Filed: Apr. 26, 1979

[51] Int. Cl.[3] ..... E04B 2/00

[52] U.S. Cl. ..... 52/405; 52/407

[58] Field of Search ..... 52/405, 404, 407, 40, 52/410

[56] References Cited

U.S. PATENT DOCUMENTS

| | | | |
|---|---|---|---|
| 2,852,934 | 9/1958 | Amundson | 52/405 |
| 3,546,833 | 12/1970 | Perreton | 52/405 X |
| 3,982,369 | 9/1976 | Releste | 52/407 |
| 4,058,948 | 11/1977 | Warren | 52/405 |

*Primary Examiner*—Carl D. Friedman

*Attorney, Agent, or Firm*—John W. Adams

[57] ABSTRACT

A building block having hollow cores therein with rigid insulating core panels inserted into each of the core cavities and having insulation sealing cap elements overlying said core panels and extending beyond the ends of the cores to overlie the masonry web portions formed between adjacent cavities and thereby form a continuous insulating sealing strip extending the full length of a block wall.

3 Claims, 4 Drawing Figures

INSULATED BUILDING BLOCK WALL CONSTRUCTION

BACKGROUND OF THE INVENTION

In the past block walls have for the most part been insulated by pouring a granular insulating material into the cavities after the blocks are in place in the wall. This granular material settles down into the block cavities, leaving uninsulated areas in the wall. Also, there are rigid inserts presently available which are placed into the main core cavities of masonry blocks. However, these inserts leave critical uninsulated areas at the small cavities between the ends of adjacent blocks and also at the mortar joints between adjacent courses of blocks. Thus, heat very easily flows around these rigid inserts and is lost thus seriously reducing the insulating effect of the inserts.

SUMMARY OF THE INVENTION

With the present invention rigid insulation panels are inserted into each cavity thus eliminating the settling problem and separate cap elements are provided which extend across the tops of the blocks in sealed relation to both the panels and upper edges of the block webs thus forming a continuous insulating barrier throughout the entire length and height of the block wall.

Figure 1:
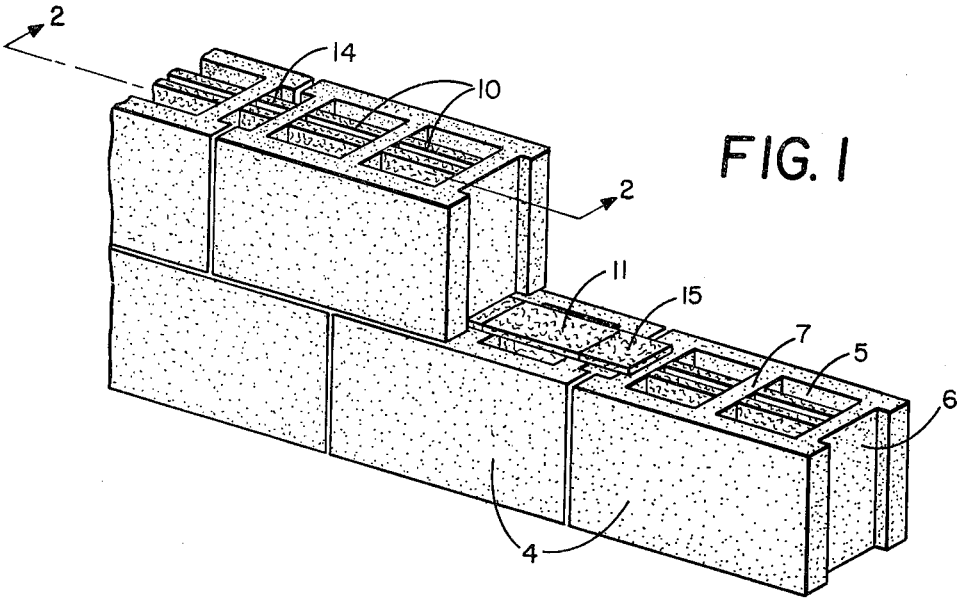
FIG. 1 is a perspective view showing a portion of a block wall embodying the invention.
Figure 2:
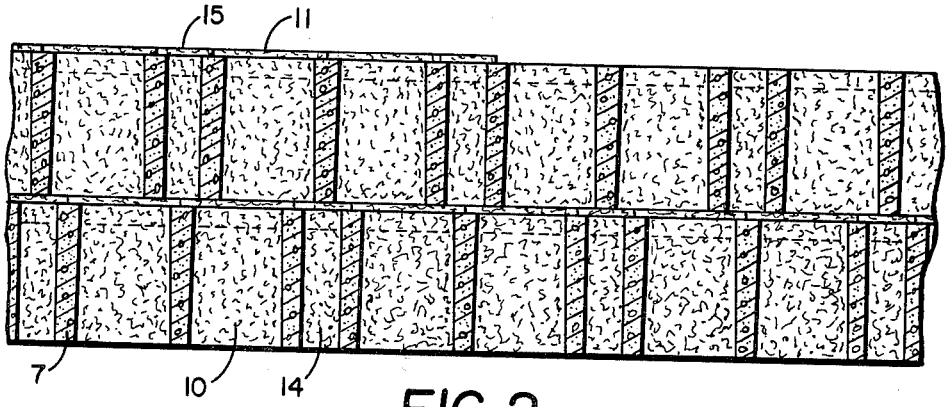
FIG. 2 is a vertical sectional view of a portion of the block wall shown in FIG. 1.
Figure 3:
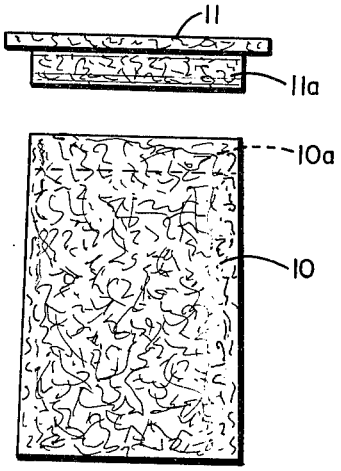
FIG. 3 is a front elevational view of an insert member and cap for a typical block cavity.

Masonry blocks such as sand and gravel or lightweight concrete blocks are used for constructing walls. Conventionally each block 4 is formed with a pair of central cavities or hollow cores 5 formed therein and a pair of end recesses 6, as best shown in FIG. 1. The central cores 5 are slightly tapered to facilitate removal of each block 4 from its forming mold (not shown) at the time of manufacture. This is best shown in the vertical sectional view designated as FIG. 2. Each cavity 5 has a barrier panel 10 of any conventional rigid insulating material (such as but not limited to polystyrene) inserted therein, as best shown in FIGS. 2 and 3. Each of these barrier panels is tapered to conform to the taper of the cavities 5 and is of a size to produce a tight wedging fit within each of said tapered cavities. The ends of the barrier panels 10 are disposed flush with the ends of the cavity or cores 5. The small end of each core 5 is located at the top of each block when the blocks are laid in the conventional manner, as best shown in FIG. 2. In the form shown, adjacent courses of blocks are laid with the ends thereof stagered so that the recesses 6 overlie the center of the masonry webs 7 of the blocks 4 disposed in the adjacent course. That is the system most commonly used; however, the blocks can also be stacked with the ends in vertical alignment.

Figure 4:
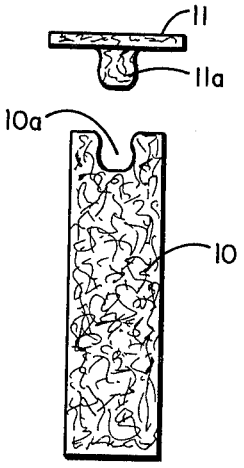
FIG. 4 is a end view of the elements shown in FIG. 3.

The shorter upper ends of each of the barrier panels 10 are grooved as indicated at 10*a* in FIG. 4, to receive a tongue element 11*a* of a cap member 11. The cap member 11 is placed over the upper grooved edge of the barrier member 10 and the tongue element 11*a* is a size to produce a forced fit in the groove 10*a* of panel 10.

Thus a positive retaining sealed fit is formed which holds each cap member 11 securely in place. The ends of the cap are sufficiently long to overlie approximately half the width of the upper ends of the block webs 7 as best shown in FIG. 1 and the ends of adjacent cap elements abut each other, as illustrated in FIG. 1 for form a continuous insulating and sealing barrier between adjacent courses of blocks.

The recesses 6 normally have straight end walls so that the recesses of adjacent blocks form a small end cavity having straight (vertical) side walls. A narrow rigid insulating barrier panel element 14 is easily inserted therein into each of these small end cavities after each course is laid and a short cap element 15 mounted thereon, as shown in FIGS. 1 and 2.

It will be seen that the cap elements 11 and 15 combine with the respectively underlying barrier panels 10 and 14 to provide a continuous insulating barrier throughout the length and height of the entire block wall, except for the masonry cross webs 7 formed in each of the blocks 4. The cap elements 11 and 15 meet in end to end relationship to provide the continuous sealing and insulating barrier strip between adjacent horizontal rows of blocks.

It will of course be understood various changes may be made in the form details arrangement and proportions of the part disclosed, without departing from the scope of this invention which generally stated is set forth in the claims appending hereto.

What is claimed is:

1. In combination with a plurality of masonry building blocks having cavities formed therein and having masonry divider webs interposed between adjacent cavities, insulating barrier panels inserted into each cavity and constructed to define a cap-receiving groove in the upper portion thereof, a cap element with a portion thereof extending above each cavity and extending horizontally beyond each cavity to overlie a portion of each web and form with adjacent cap portions, a continuous barrier strip between adjacent rows of blocks while providing an insulating barrier within each block cavity, said cap element having a portion adapted to extend downward into the groove to produce a sealing retaining fit with the respective upper edges of said cavity barrier panels.

2. The structure set forth in claim 1 wherein certain of said cavities are tapered and the insulating elements inserted therein are provided with a cooperating similar taper to facilitate wedging the panels into said cavities and thus retain the panels in predetermined insulating position within the respective cavities.

3. The structure set forth in claim 1 wherein each of the building blocks is provided with a recess at the ends thereof whereby end cavities are produced between adjacent abutting block ends, insulating barrier panels inserted into each of said end cavities with a cap portion extending above each end cavity and extending horizontally to overlie a portion of the adjacent webs and combine with adjacent cap portions to form a continuous barrier strip between adjacent rows of blocks while providing an insulating barrier within all cavities of said block row.

* * * * *